US012570435B2

(12) United States Patent
Cao

(10) Patent No.: US 12,570,435 B2
(45) Date of Patent: Mar. 10, 2026

(54) OPEN-TYPE STORAGE BASKET EASY TO ASSEMBLE

(71) Applicant: Huizhou Changwangda Hardware Products Co., Ltd., Huizhou (CN)

(72) Inventor: Guohua Cao, Huizhou (CN)

(73) Assignee: Huizhou Changwangda Hardware Products Co., Ltd., Huizhou (CN)

( * ) Notice: Subject to any disclaimer, the term of this patent is extended or adjusted under 35 U.S.C. 154(b) by 349 days.

(21) Appl. No.: 18/143,406

(22) Filed: May 4, 2023

(65) Prior Publication Data

US 2024/0317455 A1 Sep. 26, 2024

(30) Foreign Application Priority Data

Mar. 22, 2023 (CN) ..... 202320577741.0

(51) Int. Cl.

| | |
|---|---|
| ***B65D 6/08*** | (2006.01) |
| ***B65D 6/02*** | (2006.01) |
| ***B65D 6/32*** | (2006.01) |
| ***B65D 6/34*** | (2006.01) |

(52) U.S. Cl.

CPC ..... *B65D 7/16* (2013.01); *B65D 7/06* (2013.01); *B65D 7/38* (2013.01); *B65D 7/48* (2013.01)

(58) Field of Classification Search

CPC ... B65D 7/14; B65D 7/16; B65D 7/44; B65D 7/48; B65D 7/34; B65D 7/38; B65D 7/36

See application file for complete search history.

(56) References Cited

U.S. PATENT DOCUMENTS

| | | | | |
|---|---|---|---|---|
| 4,550,847 | A * | 11/1985 | Traumuller | B65D 9/06 220/684 |
| D927,817 | S * | 8/2021 | Cao | D34/21 |
| 11,142,367 | B2 * | 10/2021 | Tang | B62B 3/005 |
| 11,224,291 | B1 * | 1/2022 | Cheng | B65D 25/30 |
| D1,071,474 | S * | 4/2025 | Cao | D34/21 |
| 2006/0225378 | A1 * | 10/2006 | Hu | B65D 7/14 52/648.1 |
| 2009/0045201 | A1 * | 2/2009 | Cheng | A47B 55/02 220/494 |
| 2017/0259959 | A1 * | 9/2017 | Nilsson | B65D 7/06 |
| 2018/0208355 | A1 * | 7/2018 | Tang | B65D 7/44 |
| 2018/0339800 | A1 * | 11/2018 | Cao | B65D 7/04 |
| 2022/0281634 | A1 * | 9/2022 | Cao | A47G 29/08 |
| 2023/0391496 | A1 * | 12/2023 | Christensen | B65D 7/06 |

* cited by examiner

*Primary Examiner* — Don M Anderson
(74) *Attorney, Agent, or Firm* — Birchwood IP

(57) ABSTRACT

An open-type storage basket easy to assemble, comprising a side frame body arranged on a side and a bottom plate arranged on a bottom of the side frame body, the side frame body is formed by bending of at least one side edge frame, which have end parts connected through an X type clamping piece whose longitudinal cross section presents an X shape, the X type clamping piece includes a first V shaped metal strap arranged on one side, a second V shaped metal strap arranged on the other side; one end of the side edge frame is inserted into the first V shaped metal strap while the other end is inserted into the second V shaped metal strap; the first and second V shaped metal straps fix and connect together the side edge frame at the two ends through extrusion deformation to form side frame bodies of various shapes.

11 Claims, 12 Drawing Sheets

OPEN-TYPE STORAGE BASKET EASY TO ASSEMBLE

CROSS-REFERENCE TO RELATED APPLICATIONS

This application claims the benefit and priority of Chinese patent application No. 202320577741.0, filed on Mar. 22, 2023, disclosure of which is hereby incorporated by reference in its entirety.

TECHNICAL FIELD

The present disclosure relates to the technical field of storage of household goods, more particular to an open-type storage basket easy to assemble.

BACKGROUND

Storage baskets are common daily necessities in daily life, with diverse structures and many varieties. Existing storage baskets have articles stored in an interior thereof, and multiple storage baskets are hung on a storage rack, with a stacking arrangement, which makes full use of the storage space. The storage rack may be equipped with a roller to slide or may be fixedly hung on a wall through a hook.

As shown in FIG. 1, the existing storage basket includes a side frame body 1 arranged on a side and a bottom plate 2 arranged on a bottom of the side frame body 1. In the Chinese utility model patent CN215044542U, as shown in FIG. 2, two ends of the side frame body 1 are connected using a Z type clamping piece 3, or the side frame body 1 is connected to two ends of the bottom plate 2 using a Z type clamping piece 3. The fixing and connection are realized through extrusion, which is more environment friendly, easy to assemble and lowers the cost of production. However, there are some shortcomings, for example, since the Z type clamping piece 3 is extruded, as shown in FIG. 3, one end of the side frame body 1 is disposed on an upper side while the other end is disposed on a lower side, leading to an unlevelled height at two ends of the connection, an occurrence of a step and thus an inaesthetic outlooking. Meanwhile, multiple layers of metal sheets inside the Z type clamping piece are pressed together, leading to a thick wall at the connection and thus an inaesthetic connection position.

SUMMARY

The present disclosure aims to overcome the above shortcomings in the existing technology and provide an open-type storage basket easy to assemble, which solves the problems that two ends of the connection position of the storage basket are unlevelled in height and the connection position is not aesthetic.

In order to achieve the above aim, the present disclosure provides an open-type storage basket easy to assemble, including a side frame body arranged on a side and a bottom plate arranged on a bottom of the side frame body; the side frame body is formed by bending of at least one side edge frame, the side edge frame have end parts connected through an X type clamping piece whose longitudinal cross section presents an X shape, the X type clamping piece includes a first V shaped metal strap arranged on one side and a second V shaped metal strap arranged on the other side; one end of the side edge frame is inserted into the first V shaped metal strap while the other end is inserted into the second V shaped metal strap; the first V shaped metal strap and the second V shaped metal strap fix and connect together the side edge frame at the two ends through extrusion deformation to form side frame bodies of various shapes.

Preferably, the side edge frame has at least one side provided with a push-pull opening convenient for a hand to push and pull to place articles. The arrangement of the push-pull opening on the storage basket is convenient for a hand to push and pull the basket. The push-pull opening may be of a U shaped opening, a V shaped opening or a circular arc shaped opening convenient to push and pull.

Preferably, the side edge frame has a bottom provided with an infolding edge bending towards one side of the bottom plate, the side edge frame and the infolding edge are integrally formed by bending; the infolding edge is connected to the bottom plate through the X type clamping piece, the infolding edge is inserted into the first V shaped metal strap, the bottom plate is inserted into the second V shaped metal strap; the first V shaped metal strap and the second V shaped metal strap fix and connect together the infolding edge and the bottom plate at the two ends through extrusion deformation.

Preferably, the X type clamping piece is integrally formed; or, end parts of the first V shaped metal strap and the second V shaped metal strap are welded and fixed together by welding.

Preferably, the first V shaped metal strap includes a first metal sheet and a second metal sheet intersected; the second V shaped metal strap includes a third metal sheet and a fourth metal sheet intersected; the first metal sheet, the second metal sheet, the third metal sheet and the fourth metal sheet deform inwards through extrusion to fix and connect together internal parts to be connected.

Preferably, the side edge frame has a top provided with a guard edge used for preventing a tip part above the side edge frame hurting people, and the guard edge is of an arc or square shape formed by curling of the top of the side edge frame. Through the arrangement of the guard edge, the upper part of the side edge frame is smoother, which is adaptive to hand contact and improves the touch feeling of hand contact, further facilitates the pull out and push in of the backet, protects the user's hand against hurting and reduces safety hazards.

Preferably, the side edge frame has a corner protector wrap an exterior of a bent position of at least one side surface thereof, and the corner protector may have a pattern stamped on an outer wall thereof. The arrangement of the corner protector not only improves the rigid strength of the storage basket, but also improves the aesthetic feeling of the storage basket by stamping various decorative patterns on the outer wall of the corner protector. The corner protector is connected to the push-pull opening; the corner protector has a top provided with a wrapping part that wraps the top of the side edge frame; the corner protector has one side provided with an opening wrapping part that inclines downward, and the opening wrapping part wraps one end of the push-pull opening.

Preferably, the side frame body, the bottom plate and the corner protector are of a solid sheet metal structure, or a mesh structure, or a sheet metal structure with tensile meshes or punched holes opened in the middle, and the meshes are diamond. Or, the mesh may be arranged as a circular shape, a hexagonal shape and other shapes as actually needed.

Preferably, the side frame body and the bottom plate are square, rectangular, diamond, circular or semicircular in shape, forming a square, diamond or circular storage basket, to meet the needs of actual production of storage baskets.

Preferably, the side edge frame has a bottom provided with an infolding edge bending towards one side of the bottom plate, the side edge frame and the infolding edge are integrally formed by bending. The bottom plate is welded and fixed above the infolding edge by welding.

Compared to the existing technology, the present disclosure has the following beneficial effects.

1. According to the present disclosure, after the side edge frame is formed by bending, two ends of the side edge frame are connected and clamped through an X type clamping piece, and by extruding the X type clamping piece to deform, the side edge frame at the two ends are fixed and connected, realizing quick assembly of the side frame body, improving the production efficiency and lowering the production cost, meanwhile, the infolding edge at the bottom and the bottom plate may be connected together through an X type clamping piece, so that the storage basket may be completely fixed and assembled through the X type clamping piece, further improving the assembly efficiency and lowering the production cost.
2. According to the present disclosure, the end parts of the side edge frame are connected and clamped through an X type clamping piece whose longitudinal cross section presents an X shape, one end of the side edge frame is inserted into the first V shaped metal strap while the other end is inserted into the second V shaped metal strap; in such way, the two ends of the side edge frame to be connected are levelled in height, the connection position has a thinner thickness in cross section, and the outlooking is smoother and more aesthetic. Meanwhile, the connection position has a better stress, which is conducive to improving the bearing capability.

BRIEF DESCRIPTION OF DRAWINGS

In order to describe the technical solutions in the embodiments of the present disclosure or in the existing technology more clearly, drawings required to be used in the illustration of the embodiments or the existing technology will be briefly introduced below. Apparently, the drawings in the illustration below are merely some embodiments of the present disclosure. Those ordinarily skilled in the art also can obtain other drawings according to these provided drawings without creative work.

In the drawings.

1, a side frame body; 2, a bottom plate; 11, a side edge frame; 12, an infolding edge; 9, an X type clamping piece; 91, a first V shaped metal strap; 92, a second V shaped metal strap; 911, a first metal sheet; 912, a second metal sheet; 921, a third metal sheet; 922, a fourth metal sheet; 5, a guard edge; 4, a corner protector; 6, a push-pull opening; 3, a Z type clamping piece; 331, a fifth metal sheet; 332, a sixth metal sheet; 333, a seventh metal sheet; 41, a wrapping part.

DETAILED DESCRIPTION

The technical solutions in the embodiments of the present disclosure will be described clearly and completely hereinafter in conjunction with the drawings in the embodiments of the present disclosure. Apparently, the described embodiments are merely a part of the embodiments of the present disclosure, rather than all the embodiments. Based on the embodiments in the present disclosure, all of other embodiments obtained by the ordinary skill in the art without any creative efforts shall fall into the scope of protection of the present disclosure.

Figure 1:
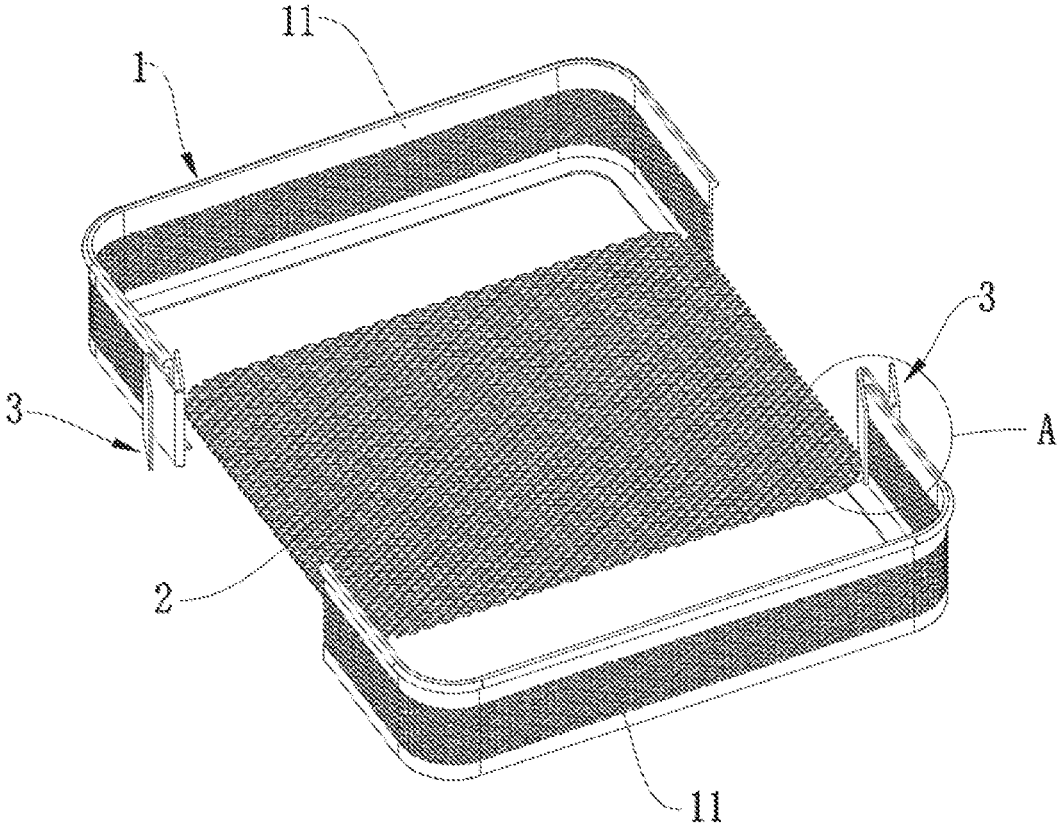
FIG. 1 is an exploded diagram of a storage basket connected using a Z type clamping piece according to the existing technology.
Figure 2:
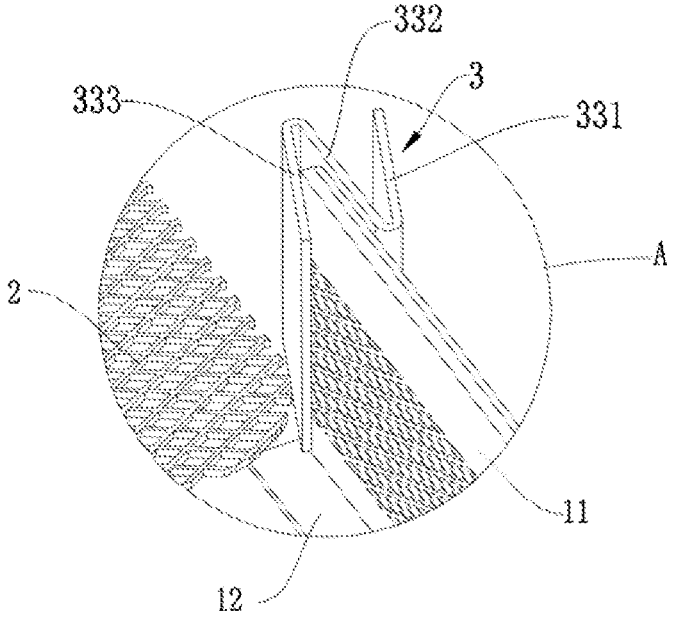
FIG. 2 is an enlarged view of part A shown in FIG. 1.
Figure 3:
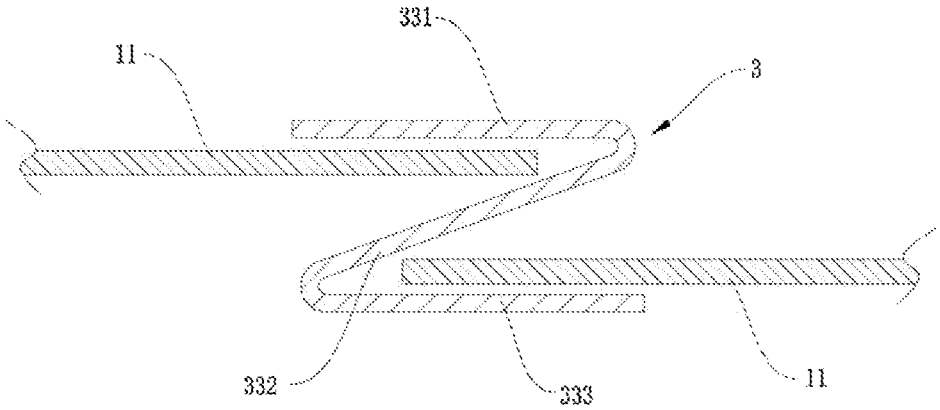
FIG. 3 is a sectional view of two ends of a Z type clamping piece that are connected to a side edge frame of a storage basket according to the existing technology.
Figure 4:
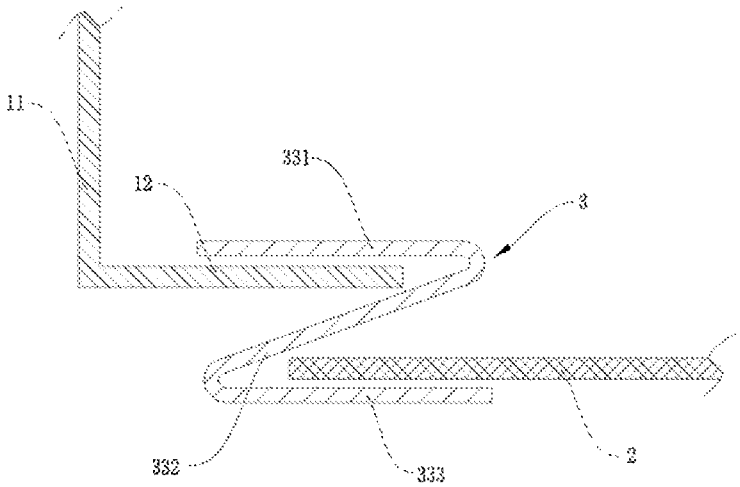
FIG. 4 is a diagram of a Z type clamping piece connected to an infolding edge in one end and connected to a bottom plate in the other end in a storage basket according to the existing technology.

As shown in FIG. 3 and FIG. 4, after the Z type clamping piece 3 is extruded to deform, one end of the side frame body 1 is disposed on an upper side while the other end is disposed on a lower side, leading to an unlevelled height at two ends of the connection. Meanwhile, due to the lamination and extrusion at the connection position, the wall of the connection position has a high thickness, being inaesthetic. Specifically, after extrusion, the wall thickness includes five layers of metal sheets, which are a fifth metal sheet 331, a side edge frame 11, a sixth metal sheet 332, a side edge frame 11 and a seventh metal sheet 333 respectively, or which are a fifth metal sheet 331, an infolding edge 12, a sixth metal sheet 332, a bottom plate 2 and a seventh metal sheet 333 respectively.

Embodiment 1

Referring to FIG. 5 to FIG. 11, the present disclosure provides an open-type storage basket easy to assemble.

Figure 5:
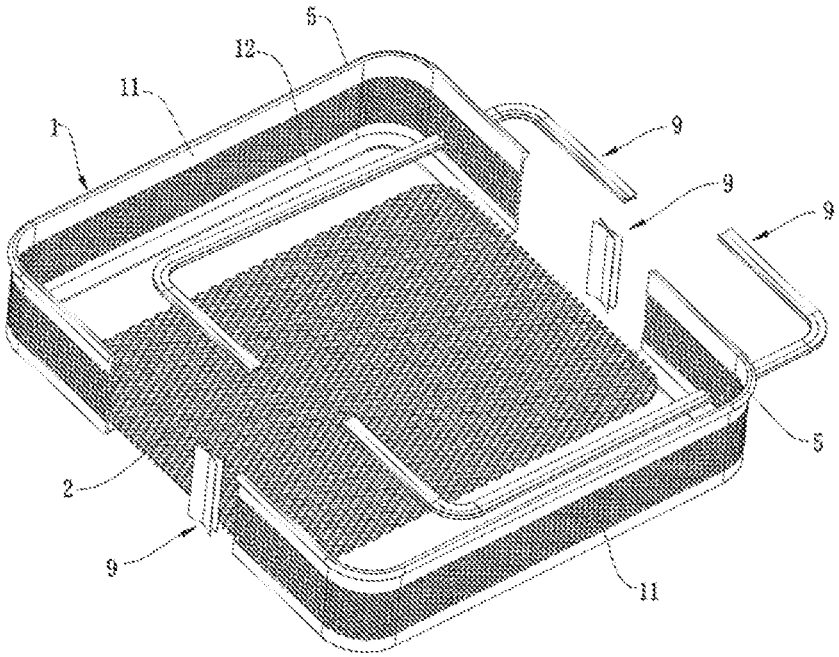
FIG. 5 is an exploded diagram of an open-type storage basket easy to assemble connected using an X type clamping piece according to the present disclosure.

As shown in FIG. 5, the storage basket includes a side frame body 1 arranged on a side and a bottom plate 2 arranged on a bottom of the side frame body 1. The side frame body 1 is used for limiting and blocking articles, and the bottom plate 2 is used for placing and supporting articles. Further, the bottom plate 2 is of a whole piece. In the present embodiment, the bottom plate 2 is a mesh plate. The side frame body 1 may be formed by assembling of one or more side edge frames 11. Specifically, the side frame body 1 includes at least one side edge frame 11 and an infolding edge 12 arranged at a bottom of the side edge frame 11. The infolding edge 12 is disposed horizontally and bends towards one side of the bottom plate 2. The side edge frame 11 is perpendicular to the infolding edge 12, and they may be integrally formed by bending of a whole rectangular sheet metal.

As shown in FIG. 5, the number of the side edge frame 11 may be one; two ends of the side edge frame 11 are connected through one X type clamping piece 9 whose longitudinal cross section presents an X shape, forming a closed entirety with head connected to tail, that is, the side frame body 1. The number of the side edge frame 11 may be two; one end of the side edge frame 11 is connected to one end of the other side edge frame 11 through an X type clamping piece 9; and multiple side edge frames 11 are connected through multiple X type clamping pieces 9, forming the side frame body 1.

Figure 6:
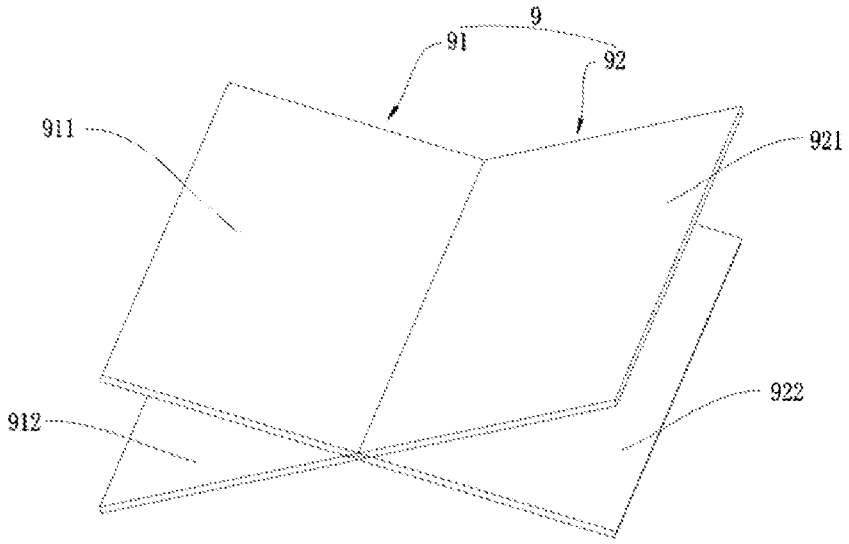
FIG. 6 is a structure diagram of an X type clamping piece according to the present disclosure.
Figure 8:
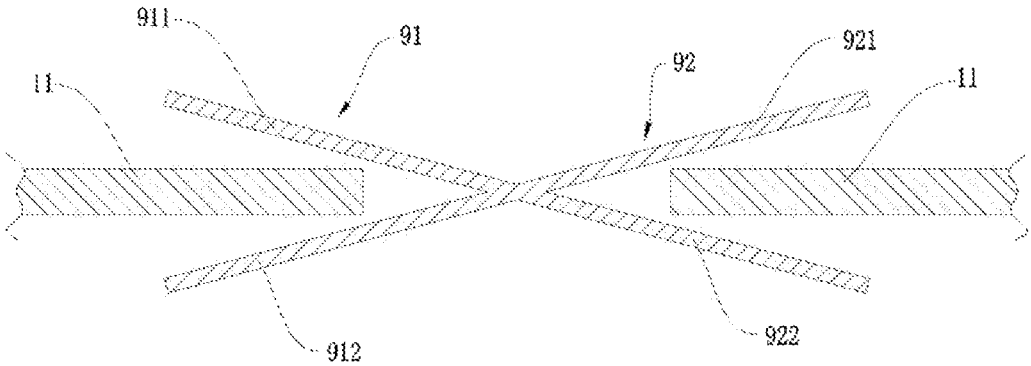
FIG. 8 is a sectional view of two ends of an X type clamping piece that are connected to a side edge frame according to the present disclosure.

As shown in FIG. 6, the X type clamping piece 9 includes a first V shaped metal strap 91 arranged on one side and a second V shaped metal strap 92 arranged on the other side. Further, as shown in FIG. 8, one end of the side edge frame 11 is inserted into the first V shaped metal strap 91 while the other end is inserted into the second V shaped metal strap 92; the first V shaped metal strap 91 and the second V shaped metal strap 92 fix and connect together the side edge frame 11 at the two ends through extrusion deformation. Still further, the side edge frame 11 inside the first V shaped metal strap 91 and the side edge frame 11 inside the second V shaped metal strap 92 are levelled in height and are still levelled after extrusion. The thickness of the cross section at the connection position includes a V shaped metal strap and a side edge frame 11, which is thinner and achieves a smoother and more beautiful outlooking at the connection position. Meanwhile, both sides of the side edge frame 11 are protected by a metal sheet, with a better stress and a higher bearing capability.

The X type clamping piece 9 deforms under a pressing state, so that the connection at two ends thereof is very firm and will not break, ensuring the reliability of the product. The arrangement of the X type clamping piece 9 achieves a very smooth and flat outer wall at the connection position, with no welding spot on the outer surface, making the outlooking of the product greatly improved and the purchasing desire of users enhanced.

Figure 7:
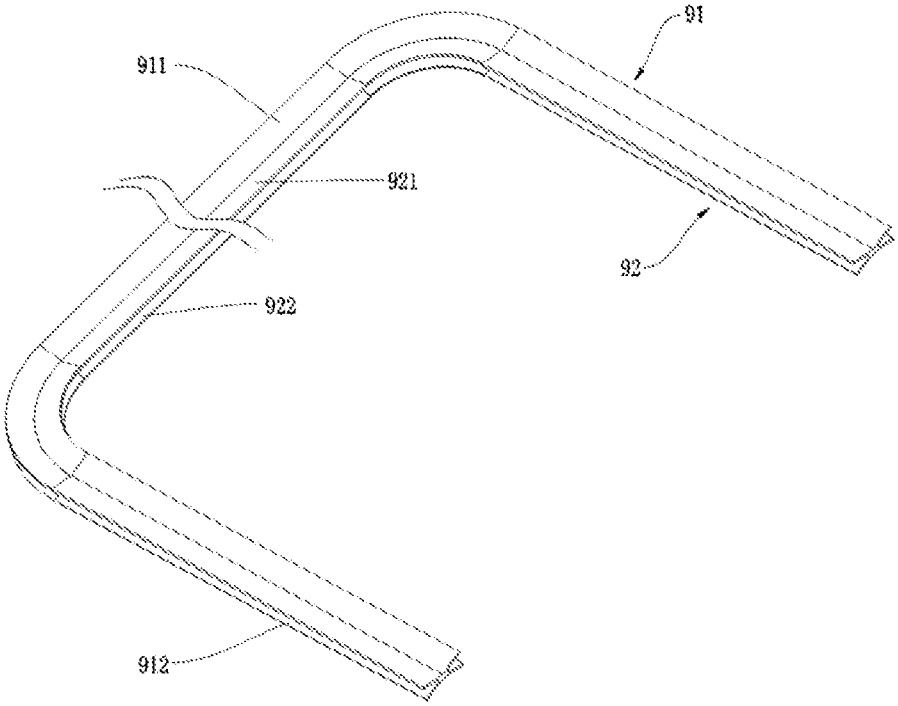
FIG. 7 is a diagram of a bending state of an X type clamping piece according to the present disclosure.
Figure 9:
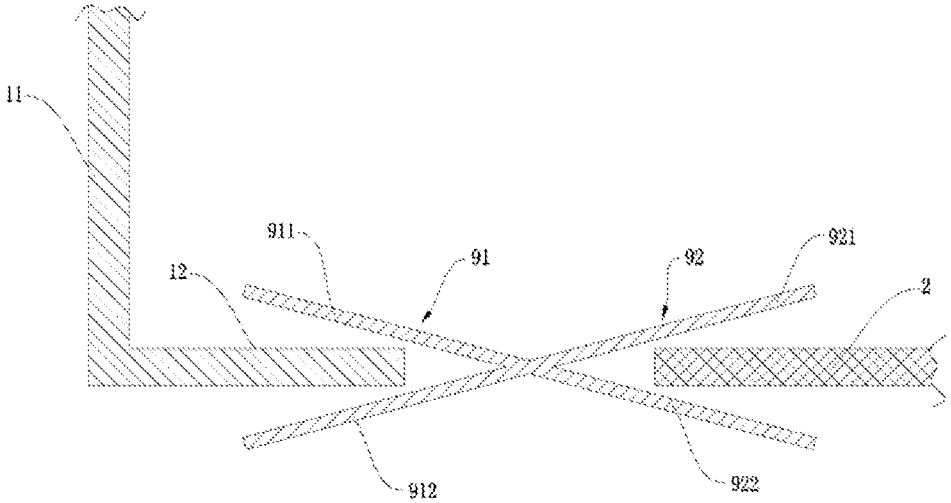
FIG. 9 is a diagram of an X type clamping piece connected to an infolding edge in one end and connected to a bottom plate in the other end according to the present disclosure.

Provided is a first connection mode between the infolding edge 12 and the bottom plate 2. As shown in FIG. 5, the infolding edge 12 is connected to the bottom plate 2 through an X type clamping piece 9. As shown in FIG. 7, the X type clamping piece 9 is of a ring shape, surrounded in between the infolding edge 12 and the bottom plate 2. As shown in FIG. 9, the infolding edge 1 is inserted into the first V shaped metal strap 91, and the bottom plate 2 is inserted into the second V shaped metal strap 92; the first V shaped metal strap 91 and the second V shaped metal strap 92 fix and connect together the infolding edge 12 and the bottom plate 2 at the two ends through extrusion deformation. Further, the first V shaped metal strap 91 and the second V shaped metal strap 92 are symmetrical about a central axis, which may be exchanged. No further description is needed here.

Figure 10:
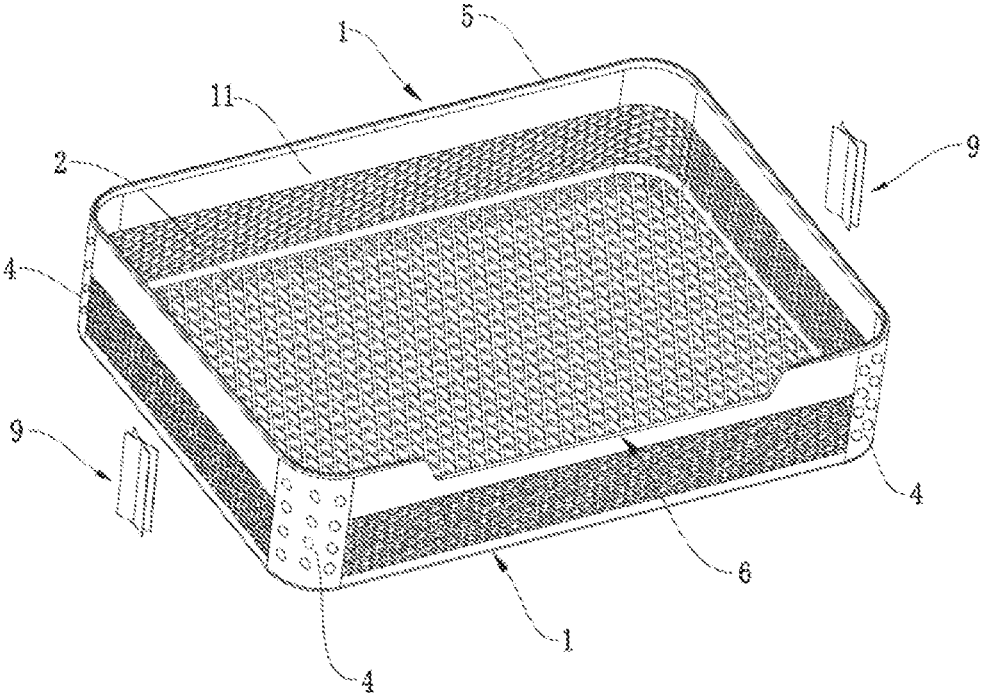
FIG. 10 is a structure diagram of an open-type storage basket easy to assemble provided with a corner protector according to the present disclosure.

Provided is a second connection mode between the infolding edge 12 and the bottom plate 2. As shown in FIG. 10, the bottom plate 2 is fixed above the infolding edge 12 by welding.

There are two forming modes for the X type clamping piece 9 too. If in mass production, as shown in FIG. 6, the X type clamping piece 9 may be produced by integrally forming. If in pilot production, first, metal sheets may be employed to bend into the first V shaped metal strap 91 and the second V shaped metal strap 92, and then the ends parts of the first V shaped metal strap 91 and the second V shaped metal strap 92 are welded and fixed together by welding.

Further, as shown in FIG. 6, the first V shaped metal strap 91 includes a first metal sheet 911 and a second metal sheet 912 intersected, the first metal sheet 911 and the second metal sheet 912 may be formed by inward bending of one metal sheet; likewise, the second V shaped metal strap 92 includes a third metal sheet 921 and a fourth metal sheet 922 intersected, the third metal sheet 921 and the fourth metal sheet 922 may be formed by inward bending of one metal sheet too. The first metal sheet 911, the second metal sheet 912, the third metal sheet 921 and the fourth metal sheet 922 deform inwards through extrusion to tightly clamp internal parts to be connected and thus fix and connect them together.

As shown in FIG. 5 and FIG. 10, the side edge frame 11 has a top provided with a guard edge 5 used for preventing a tip part above the side edge frame 11 hurting people, and the guard edge 5 is of an arc or square shape formed by curling of the top of the side edge frame 11. Through the arrangement of the guard edge 5, the upper part of the side edge frame 11 is smoother, which is adaptive to hand contact and improves the touch feeling of hand contact, further facilitates the pull out and push in of the backet, protects the user's hand against hurting and reduces safety hazards.

As shown in FIG. 10, the side edge frame 11 has a corner protector 4 wrap an exterior of a bent position of at least one side surface thereof, and the corner protector 4 may have a pattern stamped on an outer wall thereof. The arrangement of the corner protector 4 not only improves the rigid strength of the storage basket, but also improves the aesthetic feeling of the storage basket by stamping various decorative patterns on the outer wall of the corner protector 4. In addition, the outer wall of the corner protector 4 shown in FIG. 10 is provided with a plurality of convex dots, which plays the role of decoration and improves the aesthetic feeling of the storage basket.

Figure 11:
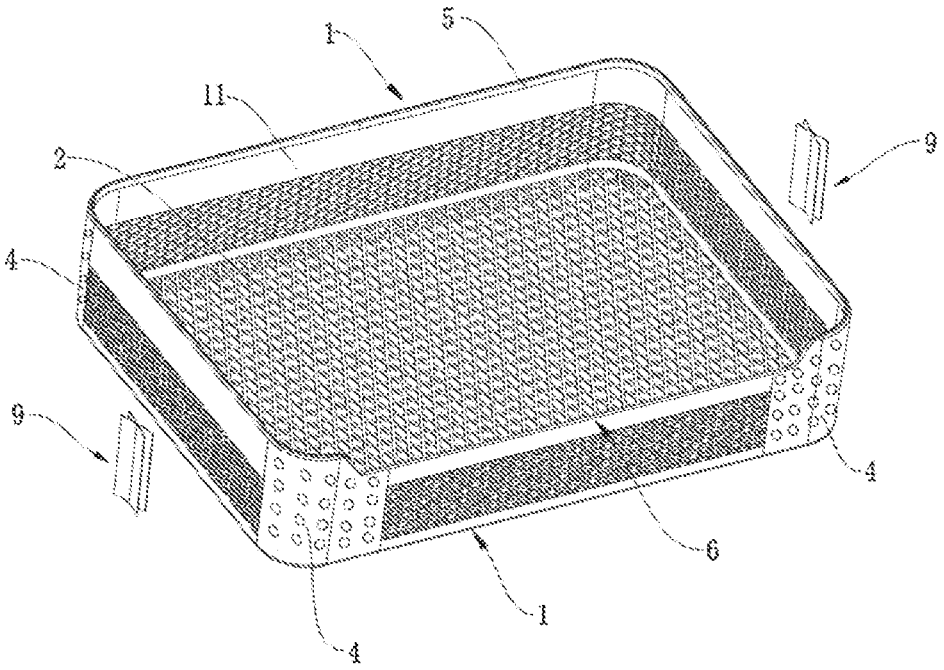
FIG. 11 is a structure diagram of an open-type storage basket easy to assemble provided with a push-pull opening according to the present disclosure.

Further, as shown in FIG. 10, the corner protector 4 directly wraps the four corners of the side edge frame 11; the side edge frame 11 has at least one side provided with a push-pull opening 6 convenient for a hand to push and pull to place articles. As shown in FIG. 11, the corner protector 4 is connected to the push-pull opening 6, the corner protector 4 has a top provided with a wrapping part 41 that wraps the top of the side edge frame 11, the corner protector 4 has one side provided with an opening wrapping part that inclines downward, the opening wrapping part wraps one end of the push-pull opening 6, and the side edge frame 11 has at least one side provided with a push-pull opening 6 convenient for a hand to push and pull to place articles.

Figure 20:
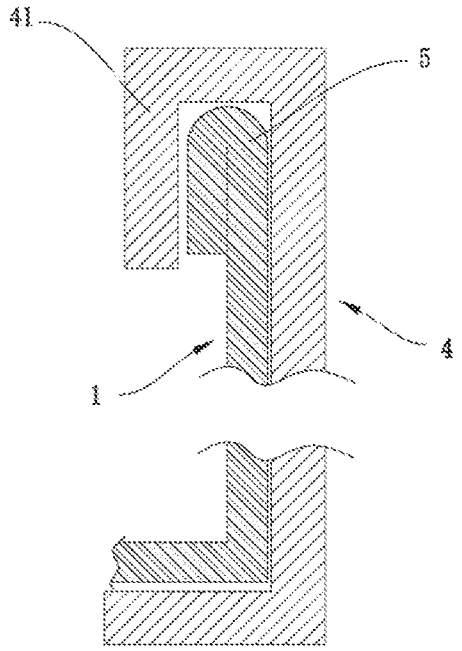
FIG. 20 is a structure diagram of a square corner protector according to the present disclosure.
Figure 21:
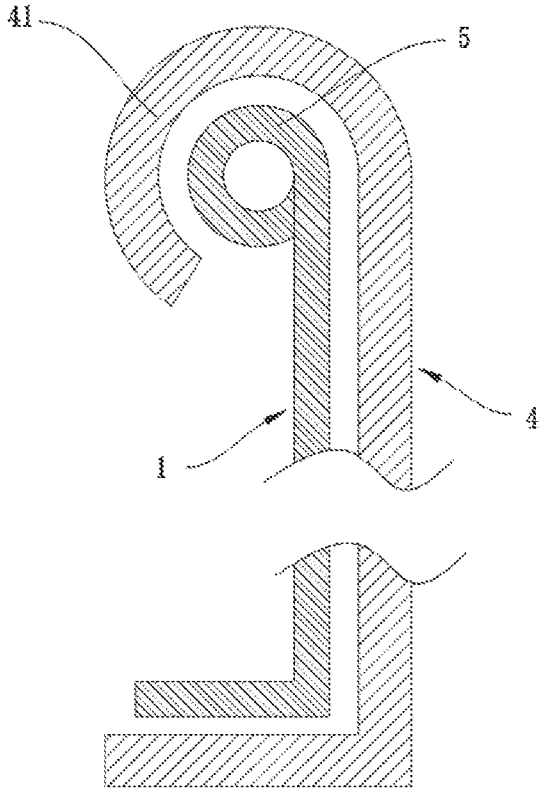
FIG. 21 is a structure diagram of a circular corner protector according to the present disclosure.

Still further, as shown in FIG. 20, the wrapping part 41 is of a square shape, being convenient to wrap the side edge frame 11. As shown in FIG. 21, the wrapping part 41 at the top of the corner protector 4 is of a circular shape, and the bottom thereof is of an L shape.

As shown in FIG. 10, the side frame body 1, the bottom plate 2 and the corner protector 4 are of a solid sheet metal structure, or a mesh structure, or a sheet metal structure with tensile meshes or punched holes opened in the middle. Specifically, the mesh plate is made of a metal material, for example, stainless steel, iron and other materials. The mesh plate has opened thereon a plurality of meshes that are evenly distributed, and each mesh runs through the mesh plate. Preferably, in the present embodiment, the mesh is diamond. Of course, the mesh may be arranged as a circular shape, a hexagonal shape and other shapes as actually needed, which is not limited to the present embodiment.

As shown in FIG. 11, the side edge frame 11 has at least one side provided with a push-pull opening 6 convenient for a hand to push and pull to place articles. The arrangement of the push-pull opening 6 on the storage basket is convenient for a hand to push and pull the basket. As shown in FIG. 11, the push-pull opening 6 is of a U shaped opening. In other embodiments, the push-pull opening 6 may be of a V shaped opening or a circular arc shaped opening which is convenient to push and pull.

In the present embodiment, both the side frame body 1 and the bottom plate 2 are rectangular, forming a rectangular storage basket. In other embodiments, the side frame body 1 and the bottom plate 2 may be square, rectangular, diamond, circular or semicircular in shape, forming a square, rectangular, diamond, circular or semicircular storage basket, to meet the needs of actual production of storage baskets.

Embodiment 2

Below are analyzed the specific structure of the storage basket easy to assemble in conjunction with the drawings.

As shown in FIG. 5, the side edge frame 11 is composed of three parts, which include an upper solid sheet metal part, a middle mesh plate and a bottom solid sheet metal part; wherein the upper solid sheet metal part has a tail end provided with a guard edge 5, which is of an arc or square shape formed by inward or outward curling. Further, as shown in FIG. 20, the guard edge 5 is formed by inward bending of a solid sheet metal part. As shown in FIG. 21, the guard edge 5 is of an arc shape formed by inward curling of a solid sheet metal part. The infolding edge 12 is of a solid sheet metal part too. Further, the infolding edge 12 is made of the same material as the bottom of the side edge frame 11 and may be formed by bending of the bottom of the side edge frame 11. Still further, the solid sheet metal part is of a metal sheet with thin thickness. The bottom plate 2 is an integrally formed mesh plate.

As shown in FIG. 5, the assembly process of the assembled storage basket is as follows. The side frame body 1 is formed by splicing of two side edge frames 11, the side edge frames 11 are connected through an X type clamping piece 9, one end of one side edge frame 11 is inserted into the first V shaped metal strap 91 while one end of the other one side edge frame 11 is inserted into the second V shaped metal strap 92. Through extrusion deformation, the side edge frames 11 at the two ends are fixed and connected together. As shown in FIG. 5, the infolding edge 12 is connected to the bottom plate 2 through an X type clamping piece 9. In the present embodiment, the X type clamping piece 9 is of a semi-ring shape, surrounded in between the infolding edge 12 and the bottom plate 2, and two X type clamping pieces 9 form a ring shape. The infolding edge 12 is inserted into the first V shaped metal strap 91, while the bottom plate 2 is inserted into the second V shaped metal strap 92. Through extrusion deformation, the infolding edge 12 and the bottom plate 2 at the two ends are fixed and connected together. In other embodiments, the X type clamping piece 9 is of a whole ring shape, and just one X type clamping piece 9 may connect the infolding edge 12 and the bottom plate 2.

Further, the infolding edge 12 may have a bending opening provided on the bent positions located at the four corners of the side frame body 1 respectively, facilitating the bending of the four corners of the high-strength side frame body 1.

Further, as shown in FIG. 11, as a simple variation of the above storage basket easy to assemble, the side edge frame 11 is composed of three parts, which include an upper solid sheet metal part, a middle mesh plate and a bottom solid sheet metal part. The infolding edge 12 is of a solid sheet metal part too. The side frame body 1 is formed by splicing of two side edge frames 11, and the side edge frames 11 are connected through an X type clamping piece 9. The bottom plate 2 is an integrally formed mesh plate and the bottom plate 2 is welded on the infolding edge 12. The side edge frame 11 has at least one side provided with a push-pull opening 6 convenient for a hand to push and pull to place articles; and the push-pull opening 6 is of a U shaped opening. The side edge frame 11 has a corner protector 4 wrap an exterior of a bent position of four side surfaces thereof, the corner protector 4 may have a pattern stamped on an outer wall thereof.

Figure 16:
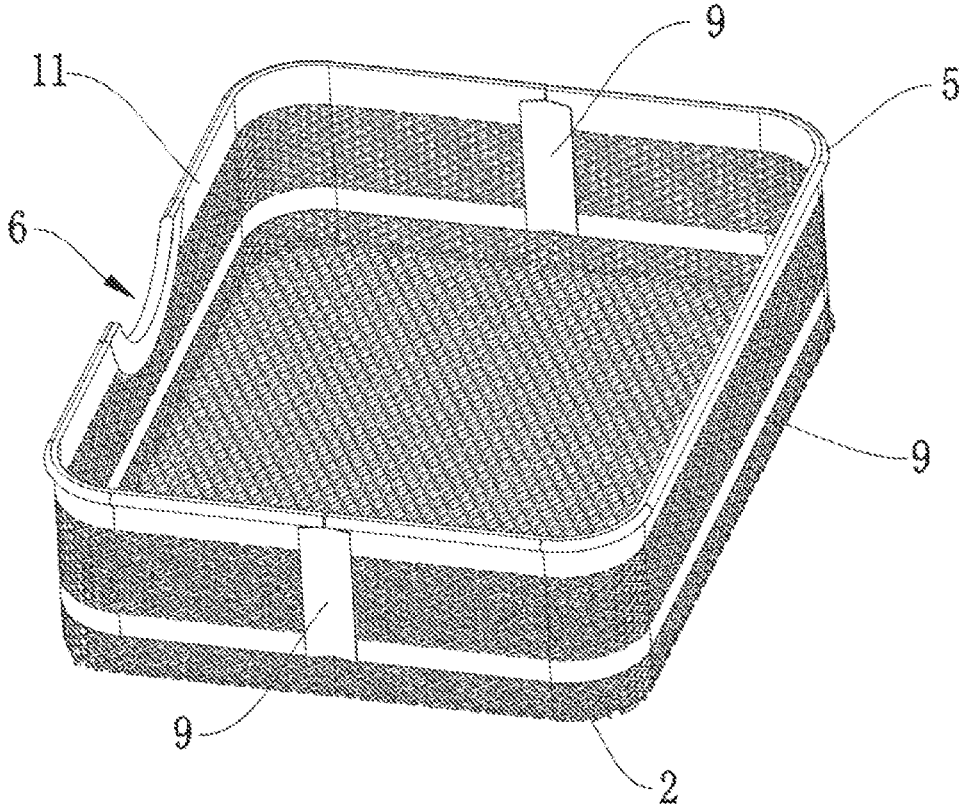
FIG. 16 is a structure diagram of a full-mesh-board storage basket according to an Embodiment 5.

Still further, as shown in FIG. 16, the push-pull opening 6 may be of a circular arc shaped opening. As shown in FIG. 20, the wrapping part 41 is of a square shape, being convenient to wrap the side edge frame 11, and the bottom of the corner protector 4 is of an L shape, being convenient to wrap the infolding edge 12. Meanwhile, the corner protector 4 has convex ball shaped decorations stamped on a surface thereof. Further, as shown in FIG. 21, the wrapping part 41 at the top of the corner protector 4 is of a circular shape, and the bottom thereof is of an L shape.

Embodiment 3

Below are analyzed the specific structure of the storage basket easy to assemble in conjunction with FIG. 12 and FIG. 13.

Figure 12:
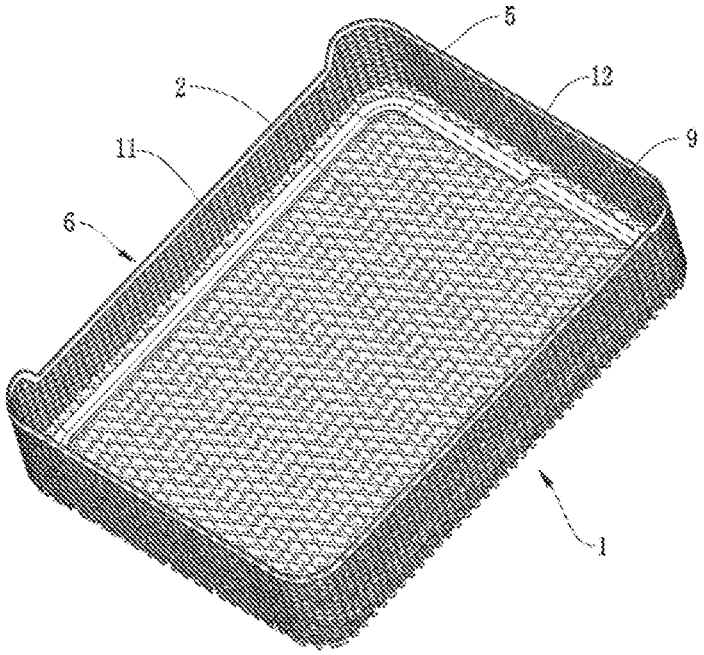
FIG. 12 is a structure diagram of a full-mesh-board storage basket according to an Embodiment 3.
Figure 13:
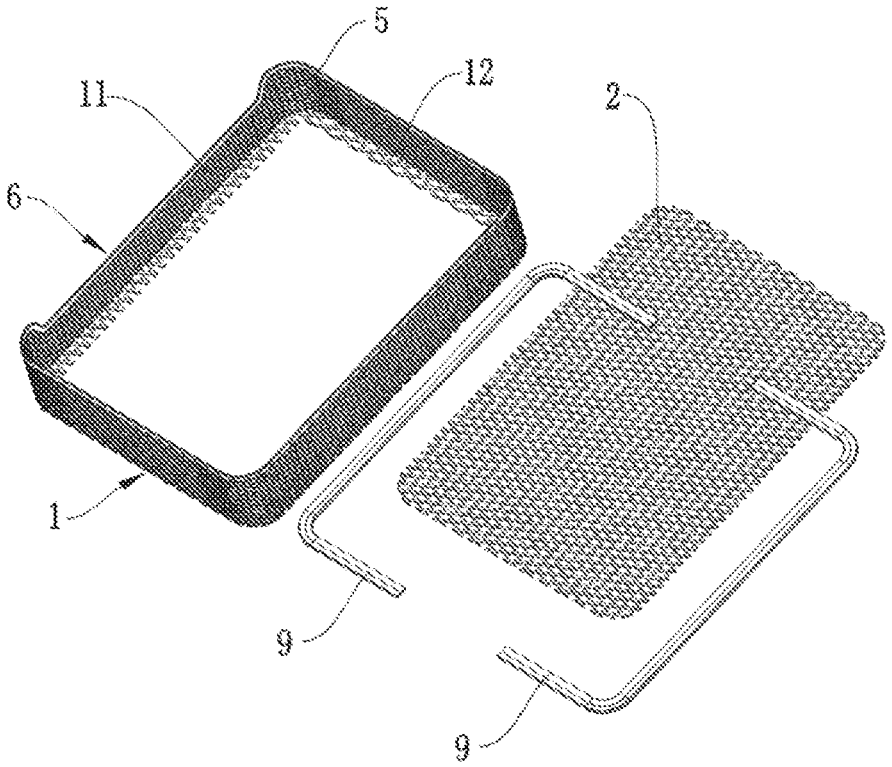
FIG. 13 is an exploded diagram of a full-mesh-board storage basket according to an Embodiment 3.

As shown in FIG. 12, the whole side frame body 1 is integrally formed by a mesh plate. In the present embodiment, the side edge frame 11 is totally composed of a mesh plate, the infolding edge 12 is composed of a mesh plate too, the side edge frame 11 and the infolding edge 12 are formed by bending, and the side edge frame 11 has an upper part provided with a guard edge 5, the side edge frame 11 has one side provided with a push-pull opening 6, and the bottom plate 2 is an integrally formed mesh plate.

The infolding edge 12 is connected to the bottom plate 2 through an X type clamping piece 9, the X type clamping piece 9 is of a semi-ring shape, and the infolding edge 12 is inserted into the first V shaped metal strap 91 while the bottom plate 2 is inserted into the second V shaped metal strap 92. The specific connection mode is as shown in FIG. 9, which shows the cross-section view of the connection position.

Further, in other embodiments, the side edge frame 11 may be composed of multiple parts, which are connected and clamped through the X type clamping piece 9.

Embodiment 4

Figure 14:
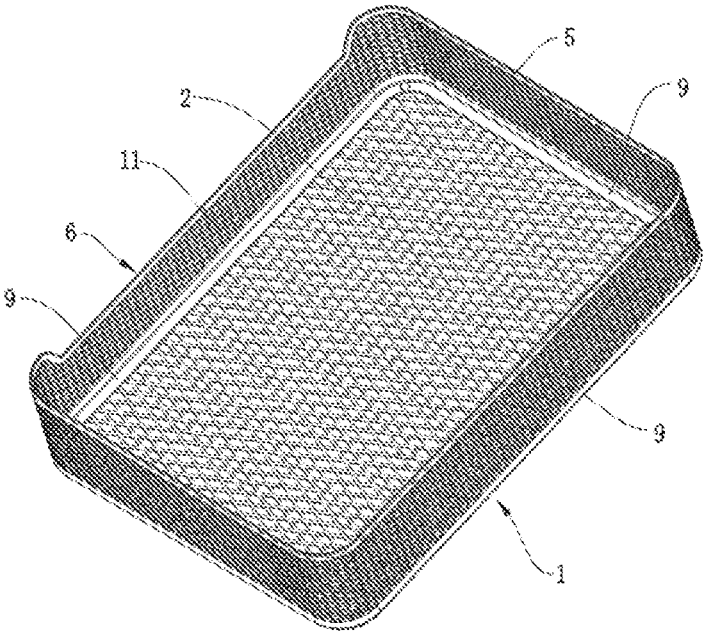
FIG. 14 is a structure diagram of a full-mesh-board storage basket according to an Embodiment 4.
Figure 15:
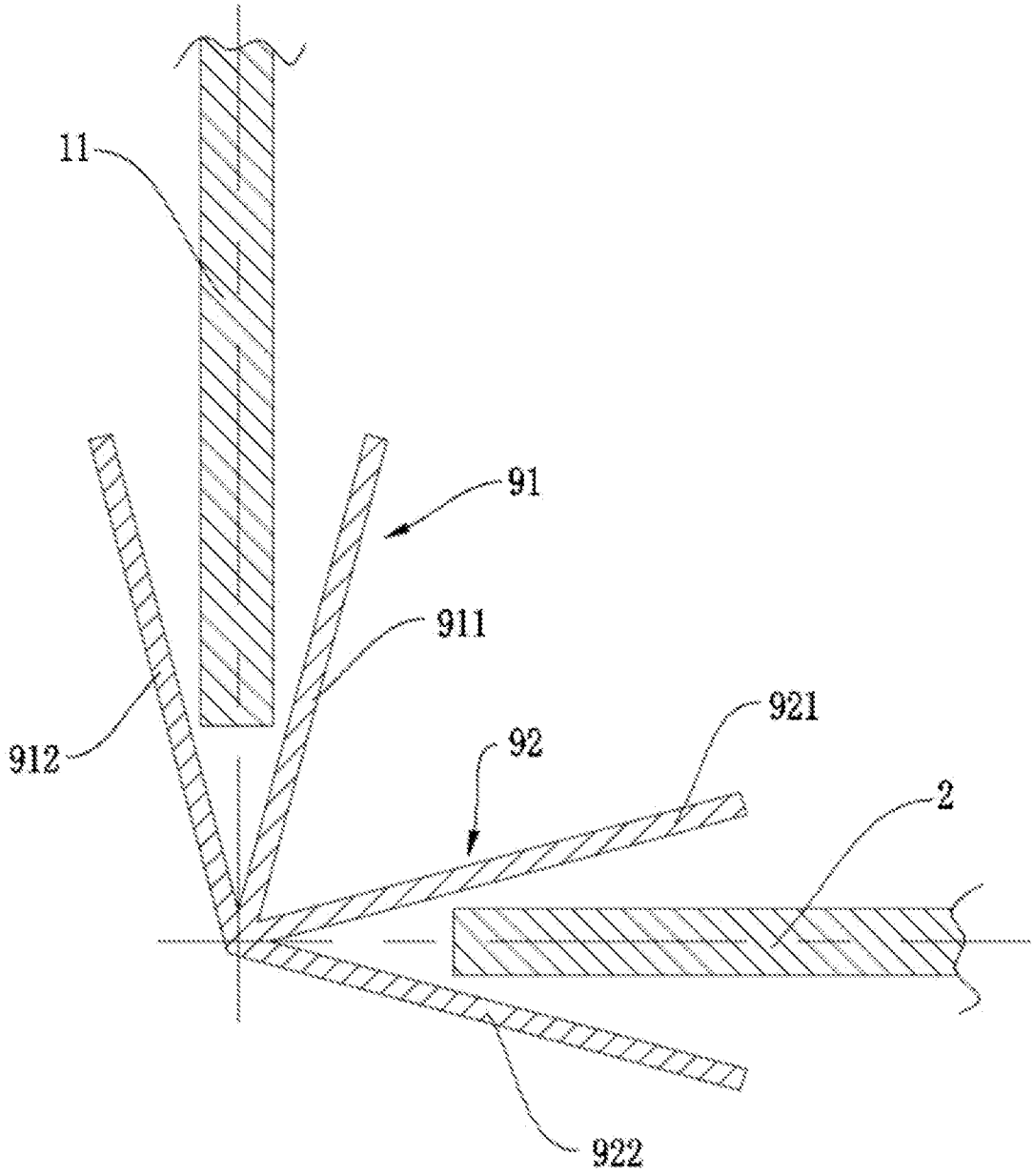
FIG. 15 is a sectional view of a connection position of a full-mesh-board storage basket according to an Embodiment 4.

Still further, as shown in FIG. 14 and FIG. 15, as a simple variation of the above storage basket easy to assemble, in the present embodiment the infolding edge 12 is omitted. The side edge frame 11 is directly connected to the bottom plate 2 through an X type clamping piece 9, the first V shaped metal strap 91 is perpendicular to the second V shaped metal strap 92, the infolding edge 12 is inserted into the first V shaped metal strap 91 while the bottom plate 2 is inserted into the second V shaped metal strap 92. The specific connection mode is as shown in FIG. 15, which shows the cross-section view of the connection position.

Embodiment 5

Below are analyzed the specific structure of the storage basket easy to assemble in conjunction with FIG. 16 to FIG. 19.

As shown in FIG. 16, in the present embodiment, the side edge frame 11 is composed of two parts, which include an upper solid sheet metal part and a lower mesh plate. In the present embodiment, the infolding edge 12 is omitted, the upper solid sheet metal part has a tail end provided with a guard edge 5. In other embodiments, the whole side frame body 1 may also be integrally formed by a mesh plate.

Figure 17:
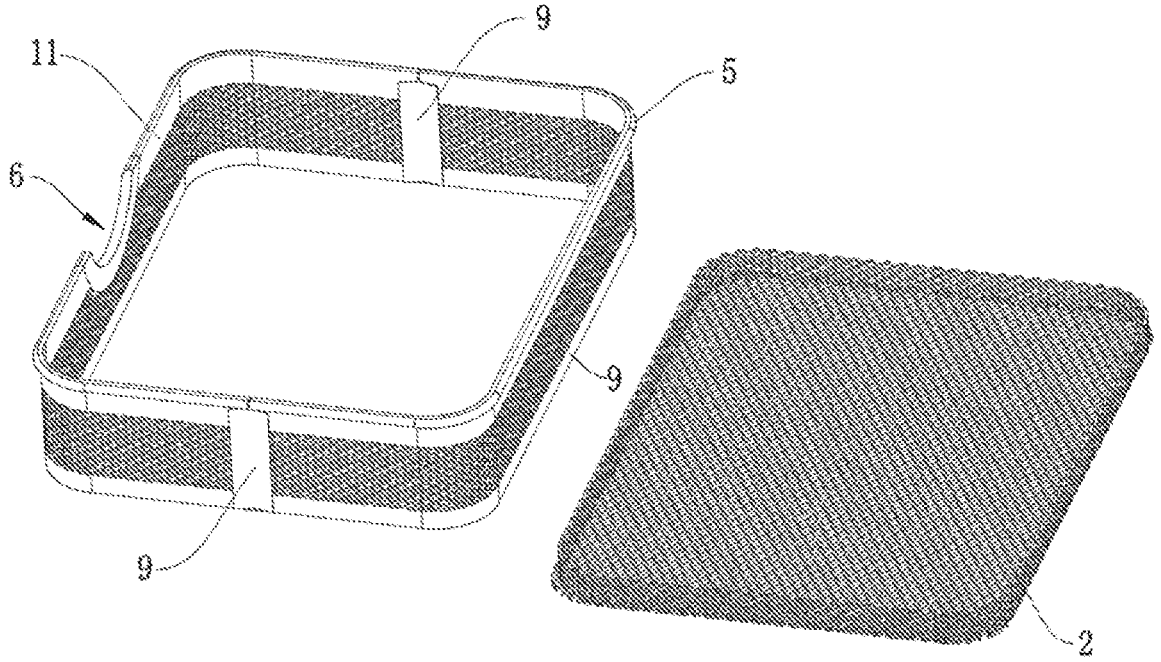
FIG. 17 is an exploded diagram of a bottom plate of a full-mesh-board storage basket according to an Embodiment 5.
Figure 18:
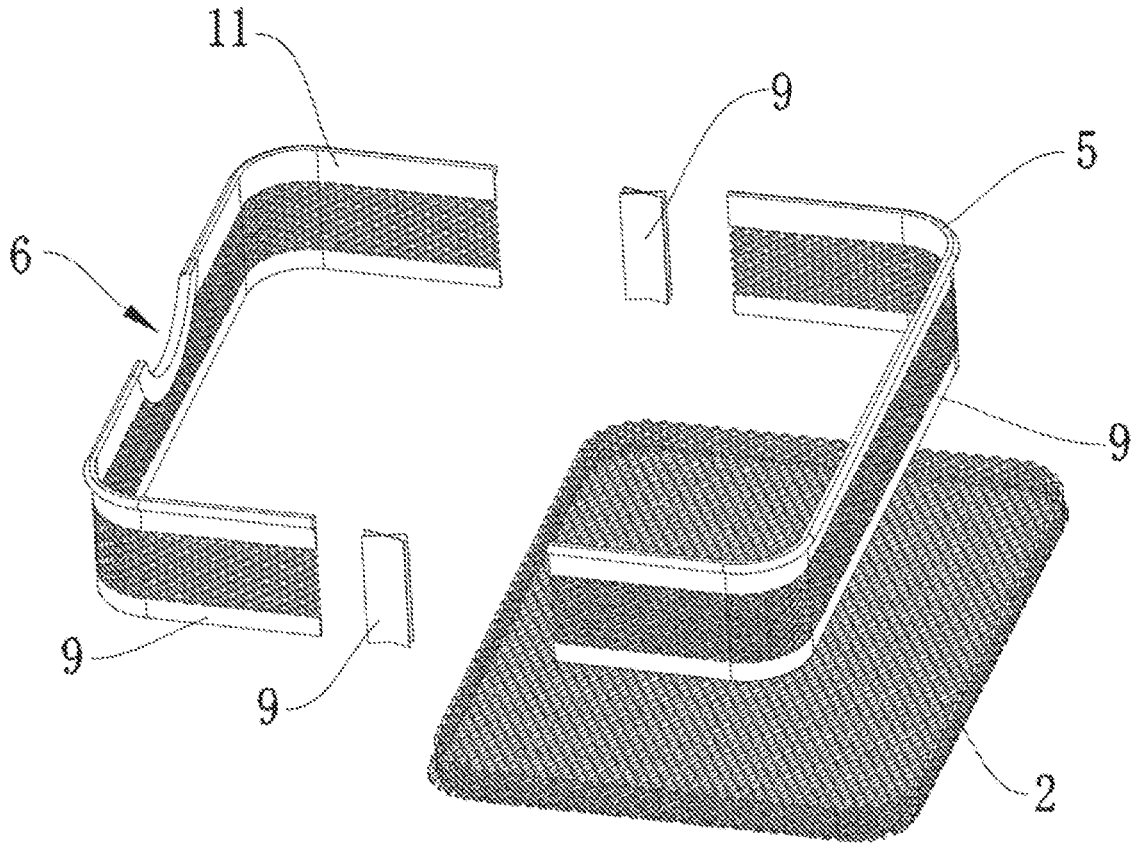
FIG. 18 is an exploded diagram of a full-mesh-board storage basket according to an Embodiment 5.

As shown in FIG. 17, the side edge frame 11 is composed of two parts and is connected through an X type clamping piece 9; the side edge frame 11 has one side provided with a circular arc shaped opening 6; the bottom plate 2 is an integrally formed U shaped mesh plate, with a surrounding thereof provided with a vertical mesh plate, and the bottom plate 2 is formed by direct stamping of a mesh plate. The side edge frame 11 is directly connected to the bottom plate 2 through an X type clamping piece 9, the side edge frame 11 is inserted into the first V shaped metal strap 91 while the bottom plate 2 is inserted into the second V shaped metal strap 92. The specific connection mode is as shown in FIG. 19, which shows the cross-section view of the connection position.

Figure 19:
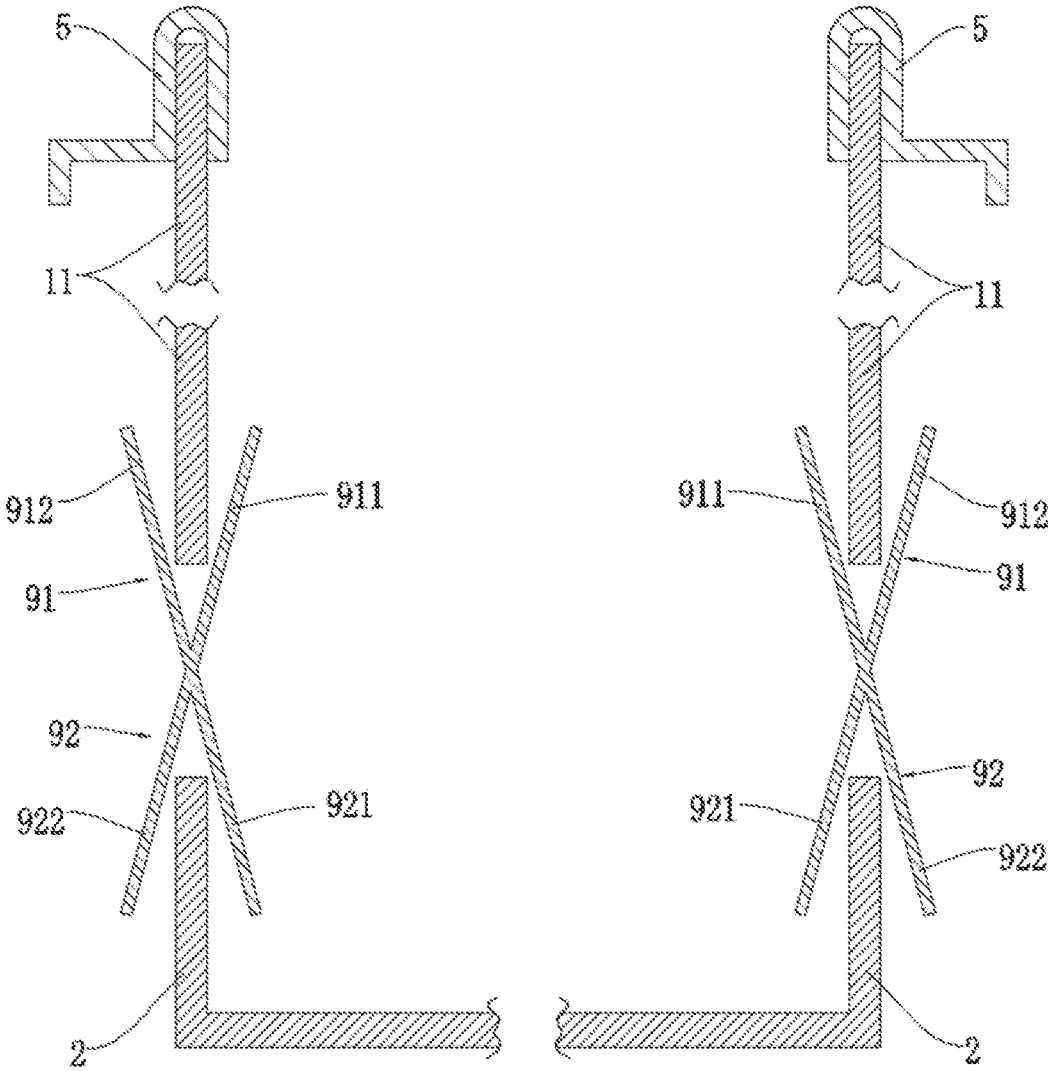
FIG. 19 is a sectional view of a connection position of a full-mesh-board storage basket according to an Embodiment 5.

Further, as shown in FIG. 19, to facilitate the pickup of the storage basket, the guard edge 5 is U shaped, with an outward folding edge.

The open-type storage basket easy to assemble provided by the present disclosure may arrange an iron wire, an inro pipe, a rib plate, a chute or a rail on the side frame body 1, or form a rib on the side frame body 1, so that the side frame body 1 is fixed with a fastener or through welding to form a basket having a storage function that can be applied to a furniture product such as a trolley, a chest of drawers, a wardrobe, a hanger and a shelf.

The above embodiments are preferred implementations of the present disclosure, rather than a limit to the implementation of the present disclosure. Any other changes, modifications, substitutions, combinations and simplifications made without departing from the spirit and principle of the present disclosure are all equivalent substitute modes and therefore shall fall within the scope of protection of the present disclosure.

What is claimed is:

1. An open-type storage basket, comprising a side frame body and a bottom plate arranged on a bottom of the side frame body, wherein the side frame body is formed by bending of at least one side edge frame, the side edge frame has end parts connected through an X type clamping piece whose longitudinal cross section presents an X shape, the X type clamping piece comprises a first V shaped metal strap arranged on one side and a second V shaped metal strap arranged on an another side;

one end of the side edge frame is inserted into the first V shaped metal strap and an another end of the side edge frame is inserted into the second V shaped metal strap;

the first V shaped metal strap and the second V shaped metal strap are configured to fix and connect together the side edge frame at two ends through extrusion deformation to form side frame bodies.

2. The open-type storage basket according to claim 1, wherein the side edge frame has at least one side provided with a push-pull opening convenient for a hand to push and pull to place articles.

3. The open-type storage basket according to claim 1, wherein the side edge frame has a bottom provided with an in folding edge bending towards one side of the bottom plate, the side edge frame and the in folding edge are integrally formed by bending.

4. The open-type storage basket according to claim 3, wherein the bottom plate is welded and fixed above the in folding edge by welding.

5. The open-type storage basket according to claim 1, wherein the X type clamping piece is integrally formed.

6. The open-type storage basket according to claim 1, wherein the X type clamping piece is configured to weld and fix together end parts of the first V shaped metal strap and the second V shaped metal strap.

7. The open-type storage basket according to claim 1, wherein the first V shaped metal strap comprises a first metal sheet and a second metal sheet intersected, the second V shaped metal strap comprises a third metal sheet and a fourth metal sheet intersected, the first metal sheet, the second metal sheet, the third metal sheet, and the fourth metal sheet deform inwards through extrusion to fix and connect together internal parts to be connected.

8. The open-type storage basket according to claim 1, wherein the side edge frame has a top provided with a guard edge, and the guard edge is of an arc or square shape formed by curling of a top of the side edge frame.

9. The open-type storage basket according to claim 2, wherein the side edge frame has a corner protector wrap an exterior of a bent position of at least one side surface thereof, the corner protector is provided with a pattern stamped on an outer wall thereof.

10. The open-type storage basket according to claim 9, wherein the side frame body, the bottom plate and the corner protector are of a solid sheet metal structure, or a mesh structure, or a sheet metal structure with tensile meshes or punched holes opened in a middle, and the tensile meshes or punched holes are diamond the meshes are diamond.

11. The open-type storage basket according to claim 1, wherein the side frame body and the bottom plate are square, rectangular, diamond, circular or semicircular in shape.

* * * * *